US010319510B2

(12) United States Patent
Murillo et al.

(10) Patent No.: US 10,319,510 B2
(45) Date of Patent: Jun. 11, 2019

(54) TRANSFORMERS WITH ALTERNATELY RADIALLY DISPOSED FIRST AND SECOND CONDUCTORS

(71) Applicant: ABB SCHWEIZ AG, Baden (CH)

(72) Inventors: Rafael Murillo, Saragossa (ES); Antonio Nogués Barrieras, Sariñena (ES); Pilar Estella, Saragossa (ES); Pedro Marqués Saldaña, Saragossa (ES); Carlos Roy Martín, Saragossa (ES); Lorena Cebrián Lles, Saragossa (ES); Luis Sánchez, Vigo (ES)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 14/925,774

(22) Filed: Oct. 28, 2015

(65) Prior Publication Data

US 2016/0118181 A1 Apr. 28, 2016

(30) Foreign Application Priority Data

Oct. 28, 2014 (EP) ..... 14190727

(51) Int. Cl.
*H01F 27/28* (2006.01)
*H01F 27/24* (2006.01)

(52) U.S. Cl.
CPC ..... *H01F 27/2823* (2013.01); *H01F 27/24* (2013.01); *H01F 27/2847* (2013.01); *H01F 2027/2838* (2013.01)

(58) Field of Classification Search
CPC ..... H01F 2027/2838
See application file for complete search history.

(56) References Cited

U.S. PATENT DOCUMENTS 1,620,552 A * 3/1927 Jacobs ..... H02G 5/025 174/129 B
2,786,152 A * 3/1957 Fisher ..... H02G 5/06 174/33

(Continued)

FOREIGN PATENT DOCUMENTS

DE 10203246 A1 8/2003
FR 1143060 A * 9/1957 ..... H02G 5/06

(Continued)

OTHER PUBLICATIONS

FR1143060A, Machine Translation, Sep. 1957.*

(Continued)

*Primary Examiner* — Elvin G Enad
*Assistant Examiner* — Malcolm Barnes
(74) *Attorney, Agent, or Firm* — Peter B. Scull; HDC IP Law LLP

(57) ABSTRACT

A transformer may comprise a winding wrapped around a magnetic core, the winding having at least one winding portion extending between the magnetic core and the exterior of the winding in radial direction. The winding may comprise at least a first conductor and at least a second conductor, arranged radially adjacent to each other in each winding portion with the interposition of an insulating layer, wherein the first conductor is arranged radially inwardly with respect to the second conductor for part of each winding portion length, and radially outwardly with respect to the second conductor for another part of each winding portion length.

4 Claims, 5 Drawing Sheets

(56) References Cited

U.S. PATENT DOCUMENTS

| | | | | | |
|---|---|---|---|---|---|
| 3,213,183 | A * | 10/1965 | Weimer | H02G 5/06 | 174/33 |
| 3,333,331 | A * | 8/1967 | Swartz | H01F 6/06 | 29/599 |
| 3,587,169 | A * | 6/1971 | Benke | H01F 27/2847 | 156/49 |
| 3,633,272 | A * | 1/1972 | Benke | H01F 27/2847 | 336/187 |
| 4,262,163 | A * | 4/1981 | Durrell | H02G 5/005 | 336/187 |
| 4,499,443 | A * | 2/1985 | Materna | H01F 6/06 | 29/599 |
| 2003/0229982 | A1* | 12/2003 | Vilander | H01F 17/0006 | 29/602.1 |
| 2008/0079528 | A1* | 4/2008 | Martin | H01F 27/2852 | 336/206 |
| 2008/0142239 | A1* | 6/2008 | Legendre | H02G 5/06 | 174/34 |
| 2009/0174511 | A1* | 7/2009 | Hahn | B60L 13/04 | 335/296 |

FOREIGN PATENT DOCUMENTS

| | | | | |
|---|---|---|---|---|
| WO | WO03065388 A1 * | 8/2003 | | H01F 27/08 |
| WO | WO03065388 A1 | 8/2003 | | |

OTHER PUBLICATIONS

Extended European Search Report for EP Application No. 14190727.9, issued by the European Patent Office, dated Mar. 4, 2015, 6 pages, Munich Germany.

* cited by examiner

TRANSFORMERS WITH ALTERNATELY RADIALLY DISPOSED FIRST AND SECOND CONDUCTORS

The present disclosure relates to transformers comprising a winding wrapped around a magnetic core.

BACKGROUND

The basic purpose of a transformer is to convert electricity at one voltage to electricity at another voltage, either of higher or lower value. In order to achieve this voltage conversion, conductors are wrapped on a core which provides a path for the magnetic flux. The conductors of the transformer may be wrapped using a plurality of techniques such a helical winding, layer winding, disc winding, foil winding, foil-disk winding, etc.

A transformer winding can include only one big and thick conductor wrapped on a core of the transformer. A problem of this solution may be that the width of the conductor in the radial direction may lead to undesired axial eddy losses in the transformer.

These eddy currents are induced by the magnetic flux generated by the current flowing through the winding, and they depend mainly on the module and direction of the magnetic flux.

In order to reduce the axial eddy losses, a conductor of the power transformer winding can include several parallel flat conductors along the radial axis of the winding instead of one big and thick conductor. These conductors may be parallel and radially adjacent with respect to each other along the total length of the winding.

A problem of this solution may be that recirculating currents may appear, which may cause extra losses and consequently an overheating which could degrade prematurely the insulations and consequently lead to an electrical failure.

The present invention aims to provide a transformer which solves at least partly the above drawbacks, by improving the performance of transformers with several parallel and radially adjacent conductors.

SUMMARY

In a first aspect, a transformer comprising a winding wrapped around a magnetic core is provided. The winding having at least one winding portion extending between the magnetic core and the exterior of the winding in radial direction. The winding comprising at least a first conductor and at least a second conductor, arranged radially adjacent to each other in each winding portion with the interposition of an insulating layer, wherein the first conductor is arranged radially inwardly with respect to the second conductor for part of each winding portion length, and radially outwardly with respect to the second conductor for another part of each winding portion length.

In a winding comprising at least a first conductor and at least a second conductor, arranged radially adjacent to each other in each winding portion with the interposition of an insulating layer, the axial losses of the transformer dependent on the width in the radial direction of the conductor may be reduced.

The configuration of the first conductor being arranged radially inwardly with respect to the second conductor for part of of each winding portion length, and radially outwardly with respect to the second conductor for another part of each winding portion length leads to the transposition of the first conductor and the second conductor along the length of each winding portion. This improves the performance of the transformer, because the recirculating currents may be reduced, thus the extra losses generated in the conductors may be avoided or at least reduced as well.

BRIEF DESCRIPTION OF THE DRAWINGS

Non-limiting examples of the present disclosure will be described in the following, with reference to the appended drawings, in which.

DETAILED DESCRIPTION OF EXAMPLES

Figure 1:
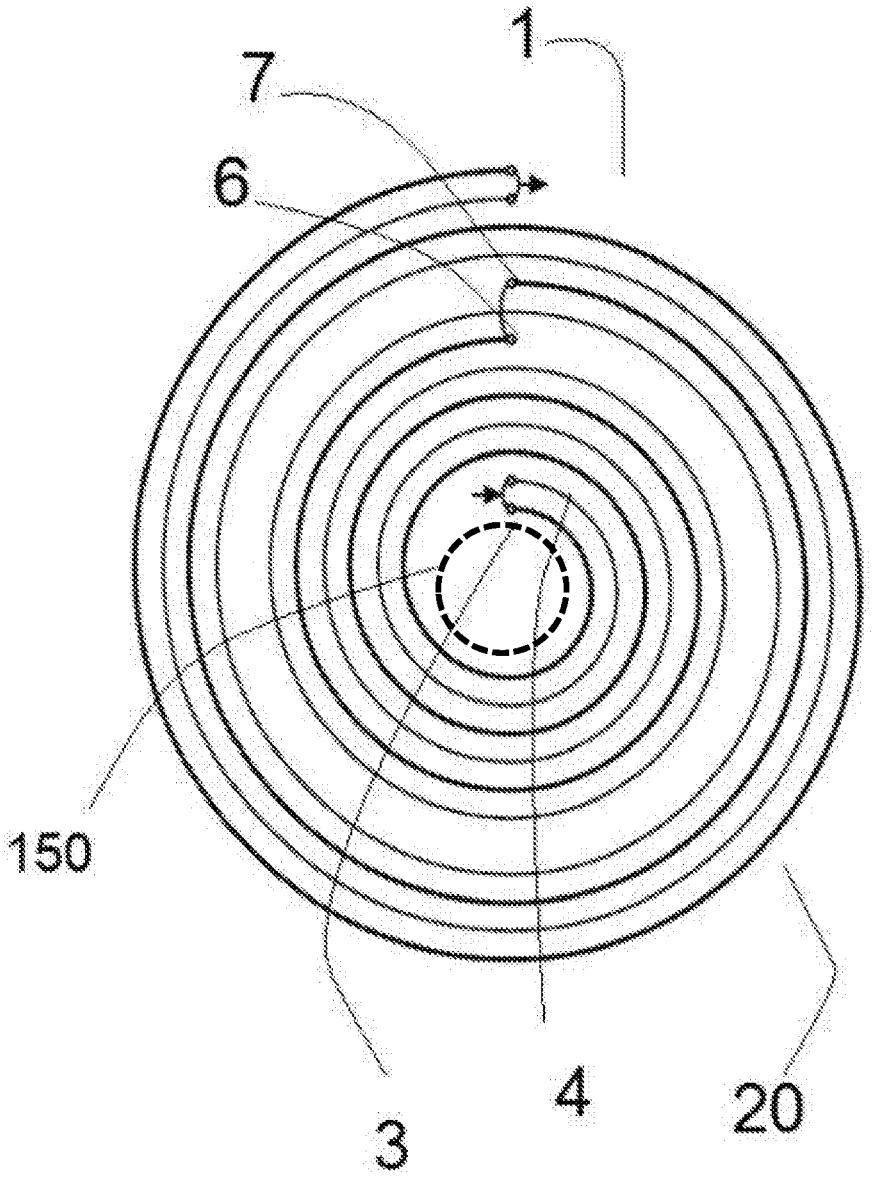
FIG. 1 schematically shows a winding of a transformer according to an implementation.

FIG. 1 shows schematically a winding of a transformer according to an implementation. The transformer may be of any known type e.g. a dry type transformer. The transformer may comprise a winding 1. The winding 1 may comprise at least one winding portion e.g. winding portion 20 extending between the magnetic core 150 and the exterior of the winding in radial direction. Furthermore, the winding 1 may be wrapped around a magnetic core.

The winding 1 may be made of a conducting material e.g. copper or aluminium. The winding 1 may comprise a plurality of electrically insulated conductors.

The winding 1 may have a foil-disc winding configuration. In this configuration, each winding portion may be a disc. The required conductors e.g. two strips may be wound in a plurality of these discs spaced apart along the axial length of the winding. The conductors may be rectangular in cross-section and the conductors may be wound in a radial direction parallel to each other, one on top of the other until the required number of turns per disc has been wound.

In some other examples, the winding 1 may have a foil winding configuration. In this configuration, one winding portion may be a foil. The required number of conductor foils e.g. two conductor foils may be wound. The conductor foils may be rectangular in cross-section and the conductor foils may be wound in a radial direction parallel to each other, one on top of the other, until the required number of turns has been wound.

In examples, the winding 1 may comprise a first conductor 3 e.g. a first conductor foil or a first strip and a second conductor 4 e.g. a second conductor foil or a second strip. The first conductor 3 and the second conductor 4 may be arranged radially adjacent to each other in the winding with the interposition of an insulating layer (not shown). With this arrangement, the undesired axial eddy losses in the transformer related to the radial width of the conductor may be reduced.

The first conductor 3 and the second conductor 4 may be transpositioned; the transposition of the conductors refers to the exchanging of position of the first 3 and the second 4 conductor along the winding portion 20 in such a manner that the first part 3*a* of the first conductor 3 may be located radially inwardly with respect to second conductor 4 and the second part 3*b* of the first conductor 3 may be located radially outwardly with respect to the second conductor 4. With this transposition of the conductors along the winding portion 20 the recirculating current and, consequently, the extra losses and the overheating of the winding, may be reduced.

At least one of the conductors, for example the first conductor 3, may be discontinuous along the length of the winding portion 20. More particularly, the first conductor 3 may comprise a first part 3*a* in which the first conductor is arranged radially inwardly with respect to the second conductor 4 for part of the winding portion length and a second part 3*b* in which the first conductor is arranged radially outwardly with respect to the second conductor 4 for another part of the winding portion length. The first part 3*a* may comprise a first intermediate end 6 and the second part 3*b* may comprise a second intermediate end 7, wherein the two ends 6, 7 are intended to be connected to each other to allow current flow in the first conductor. The second conductor 4 may be continuous along the length of the winding portion.

The first conductor 3 and the second conductor 4 may be made of e.g. aluminum or copper although some other conductor materials may be possible.

Figure 2A:
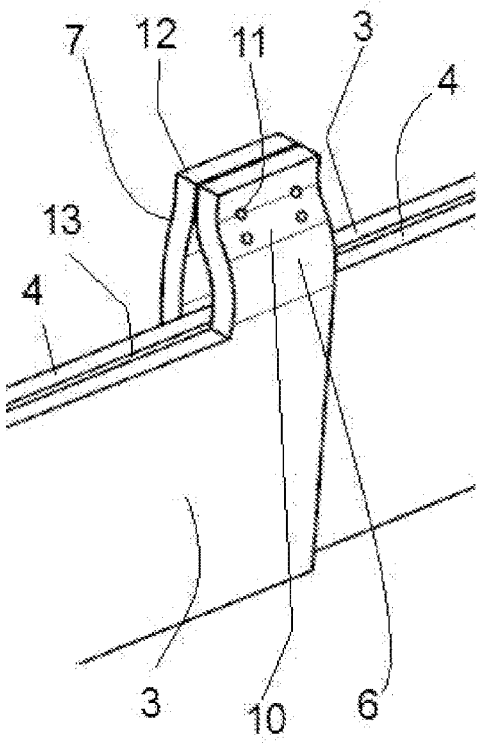
FIGS. 2*a*-2*c* schematically show the transposition between a first and a second conductor according to examples.
Figure 2B:
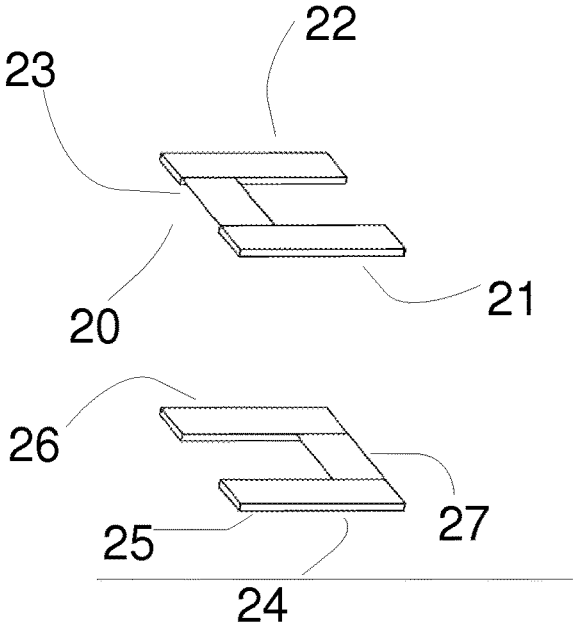
Figure 2C:
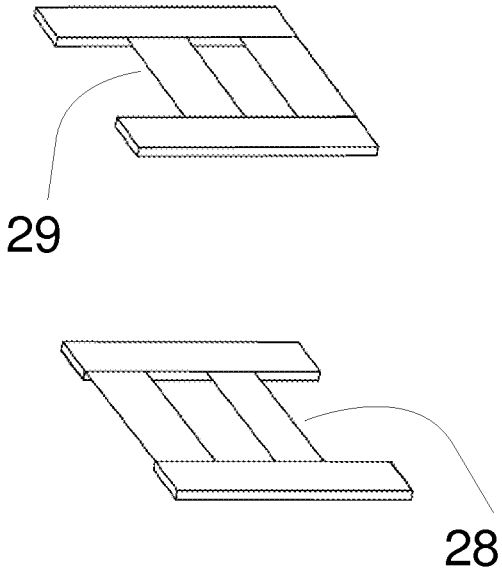

FIGS. 2*a*-2*c* show examples of the transposition between the first conductor 3 and the second conductor 4. In FIG. 2*a*, as commented above, the first conductor 3 may be discontinuous along the length of the winding portion, and have a first intermediate end 6 and a second intermediate end 7. The two separate parts or lengths of the first conductor 3, each ending with one of the intermediate ends 6 and 7, are arranged on different sides of the second conductor 4, and their ends 6 and 7 are intended to be connected together. This structure allows the transposition between the two conductors 3 and 4, that is, the change in their relative radial position, such that each conductor is arranged radially inwardly with respect to the other along a length of the winding portion, and is arranged radially outwardly with respect to the other along another length of the winding portion.

The first intermediate end 6 may comprise a first elongated lead-out 10. The elongated lead-out 10 may comprise a plurality of fasteners 11, such as bolts, pins, studs or the like. The second intermediate end 7 may comprise a second elongated lead-out 12. The elongated lead-out 12 may comprise a plurality of holes (not visible) in which the fasteners 11 are to be fitted in order to assemble the first conductor with the second conductor.

An insulating layer element 13 may be provided so as to maintain two separate electric current paths in conductors 3 and 4. The insulation layer 13 may be made of rubber-like polymers and/or plastics although some other insulation materials may be possible.

The first intermediate end 6 and the second intermediate end 7 may be aligned with, for example, a centering element (not shown), thus resulting in the fasteners 11 of the first conductor 3 being aligned with the openings of the second conductor 4. This way, the first intermediate end 6 may be fastened into the plurality of openings of the second intermediate end 7, thus the first part of the first conductor 3 may be connected to the second part of the first conductor 3. In consequence, the first conductor 3 may pass from one side of the second conductor 4 to the other side. This structure allows the transposition between the two conductors 3 and 4, that is, the change in their relative radial position, such that each conductor is arranged radially inwardly with respect to the other along a length of the winding portion, and is arranged radially outwardly with respect to the other along another length of the winding portion.

In FIG. 2*b*, a first socket 20 and a second socket 24 may be provided. The first socket 20 may be connected e.g. welded to the first intermediate end of the first conductor. The second socket 24 may be connected e.g. welded to the second intermediate end of the first conductor.

The first socket 20 may comprise a first leg 21, a second leg 22 and a first bight portion 23. The first bight portion 23 may be configured to join the first leg 21 and the second leg 22. The second socket 24 may comprise a first leg 25, a second leg 26 and a second bight portion 27. The second bight portion 27 may be configured to join the first leg 25 and the second leg 26 of the second socket 24.

The second socket 24 may include a hole (not shown) in which the first leg 21 and the second leg 22 of the first socket 20 may be fit for making electrical contact with the second socket 24 when the first leg 21, the second leg 22 (and thus the bight portion 23) are fit into the hole. Alternatively, the hole for making electrical contact may be situated in the first socket 23.

In examples, a locking mechanism for connectors may be provided. The locking mechanism e.g. a clamp may prevent the connectors from being insufficiently engaged and it may allow the connectors to be engaged or disengaged with ease.

With this arrangement, the first intermediate end of the first conductor may be connected to the second intermediate end of the second conductor using the first socket 20 and the second socket 24, thus the first conductor may pass from one side of the second conductor to the other side. This structure allows the transposition between the two conductors, that is, the change in their relative radial position, such that each conductor is arranged radially inwardly with respect to the other along a length of the winding portion, and is arranged radially outwardly with respect to the other along another length of the winding portion. With this transposition of the conductors along the winding portion the recirculating current and, consequently, the overheating of the winding, may be reduced.

The first and second socket 20, 24 may be made of aluminium or copper although some other conductor materials may be possible.

The structure and operation of the first conductor, the second conductor and the insulating layer may be the same as described in the FIGS. 1 and 2*a*.

FIG. 2*c*, the operation of the sockets may be the same as described in the FIG. 2*b*. The structure of the sockets may also be the same with the inclusion of a second bight portion 29 at the first socket and the inclusion of a second bight portion 28 at the second socket.

Figure 3:
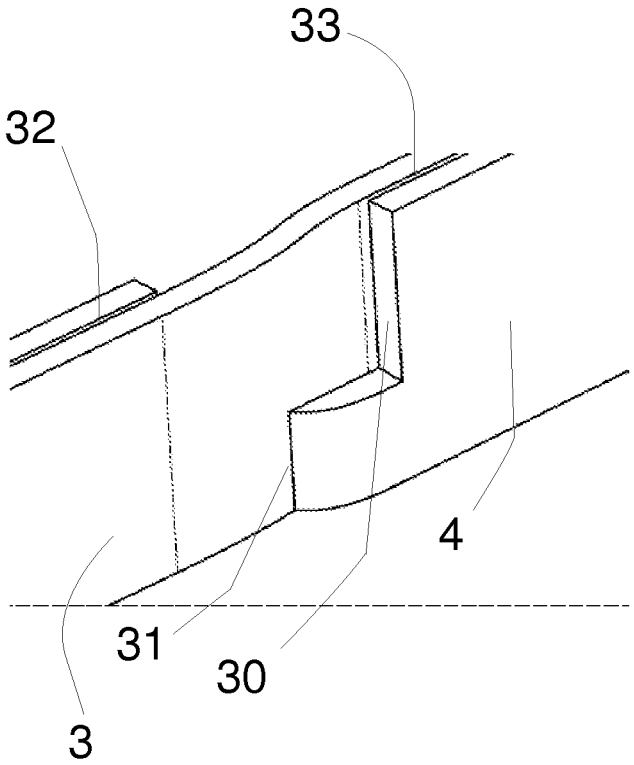
FIG. 3 schematically shows the transposition between a first and a second conductor according to another example.

FIG. 3 schematically shows the transposition between the first conductor 3 and the second conductor 4 according to another example. In this FIG. 3, the first conductor 3 may comprise a first guide channel 31 and the second conductor 4 may comprise a second guide channel 30. The first guide channel 30 and the second guide channel 31 may comprise a groove cut below or above or in between the normal surface of the first conductor 3 and the second conductor 4. In this particular example, the first guide channel 30 may comprise a groove cut above the normal surface and the second guide channel 31 may comprise a groove cut below the normal surface.

Furthermore, a first insulation layer 32 and a second insulation layer 33 may be provided. The first insulation layer 32 may be located between the first conductor 3 and the second conductor 4 along the first part of the winding portion, thus two separate electric current paths may be maintained in conductors 3 and 4 along this first part of the winding portion. In the same way, the second insulation layer 33 may be located between the first conductor 3 and the second conductor 4 along the second part of the winding portion, thus two separate electric current paths may be maintained in conductors 3 and 4 along this second part.

In this arrangement, the first guide channel 30 may be configured to fit with the second guide channel 31, thus the first conductor 3 may pass at least in part through the second conductor 4. This structure allows the transposition between the two conductors, that is, the change in their relative radial position, such that each conductor is arranged radially inwardly with respect to the other along a length of the winding portion, and is arranged radially outwardly with respect to the other along another length of the winding portion. With this transposition of the conductors along the winding portion the recirculating current and, consequently, the overheating of the winding, may be reduced In this particular example, a first and a second guide channel have been depicted although in some other examples the transposition between the first conductor and the second conductor may be performed with three or more guide channels located at the first and the second conductor.

The first insulation layer 32 and a second insulation layer 33 may be made of rubber-like polymers and/or plastics although some other insulation materials may be possible.

Figure 4A:
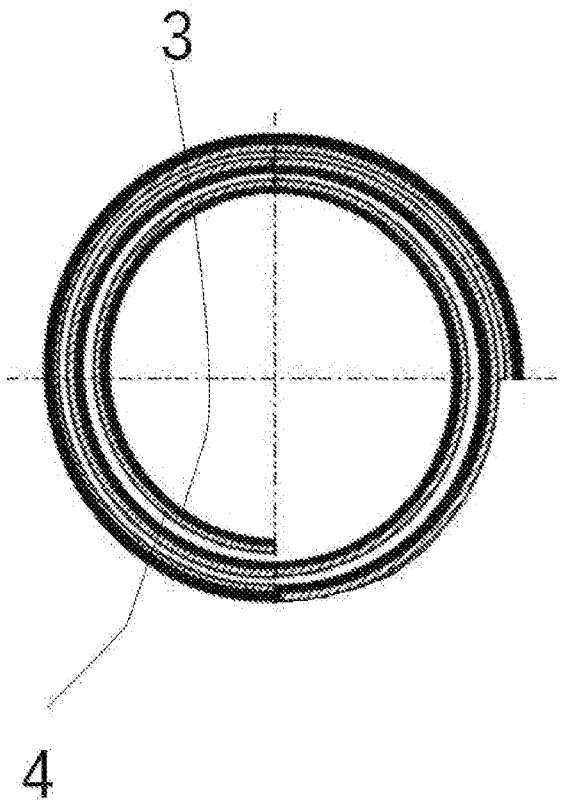
FIGS. 4*a*-4*b* schematically show a foil winding configuration according to examples.
Figure 4B:
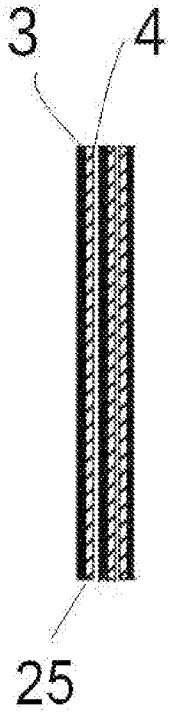

FIGS. 4*a*-4*b* schematically show a foil winding configuration according to examples. In this configuration, the transformer may comprise one winding portion which may be regarded as a foil. In FIG. 4*a*, the first conductor 3 may be a first conductor foil and the second conductor may be a second conductor foil 4. The first conductor foil and the second conductor foil may be spaced apart with respect to each other in the radial direction of the foil. With this arrangement, the first conductor foil may be arranged radially inwardly with respect to the second conductor foil for part of the foil length, and radially outwardly with respect to the second foil for another part of the foil length.

This structure allows the transposition between the two conductors foils, that is, the change in their relative radial position, such that each foil conductor is arranged radially inwardly with respect to the other along a length of the foil, and is arranged radially outwardly with respect to another length of the foil. With this transposition of the foil conductors along the foil the recirculating current and, consequently, the overheating of the winding, may be reduced.

FIG. 4*b* shows a cross-sectional view of the winding. A commented above, in this example, the transformer may comprise one winding portion 25 which may be regarded as a foil. The first conductor foil 3 and the second conductor foil 4 may be spaced apart with respect to each other in the radial direction of the winding. The first conductor foil 3 and the second conductor foil 4 may be rectangular in this cross-sectional view.

Figure 5A:
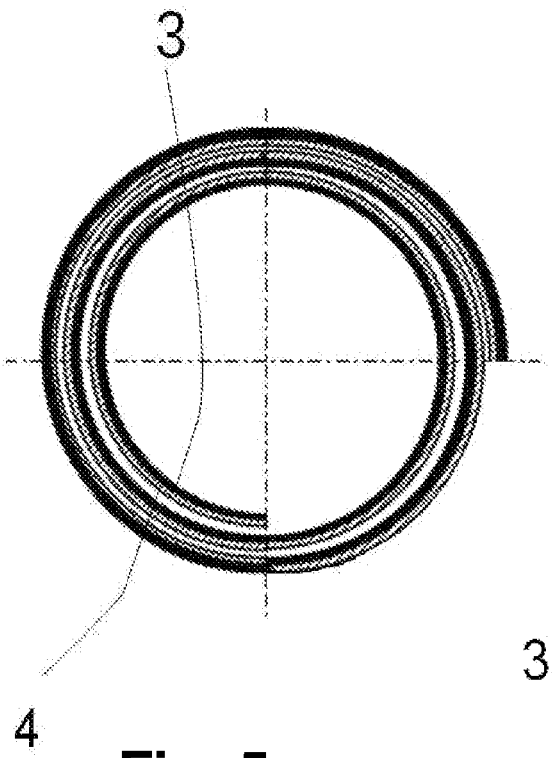
FIGS. 5*a*-5*b* schematically show a foil-disc winding configuration according to examples.
Figure 5B:
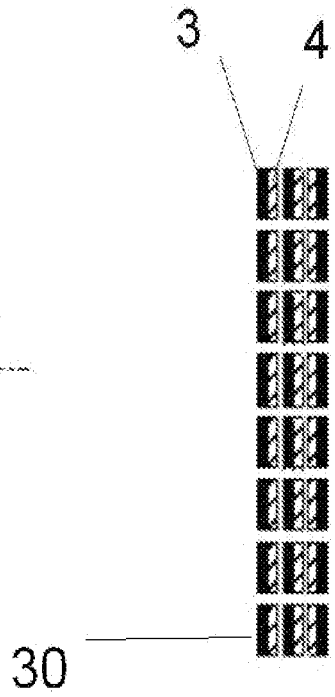

FIGS. 5*a*-5*b* schematically show a foil-disc winding configuration according to examples. In this example, the transformer may comprise a plurality of winding portions. Each winding portion may be a disc. In FIG. 5*a*, the first conductor 3 may be a first strip and the second conductor 4 may be a second strip. The strips may be wrapped spaced apart with respect to each other in the radial direction of the winding and in a plurality of discs spaced apart with respect to each other in the axial direction of the winding. For each disc, the first strip may be arranged radially inwardly with respect to the second strip for part of the disc length, and radially outwardly with respect to the second conductor for another part of the disc length. Furthermore, may be a space between each pair of discs. In some examples, the space may be filled with an insulating material e.g. resin.

FIG. 5*b* shows a cross-sectional view of the winding. In this configuration, each winding portion p.ej, the winding portion 30 is a disc. As commented above, the first conductor 3 may be a first strip and the second conductor 4 may be a second strip. The first strip may be arranged radially inwardly with respect to the second strip for part of the disc length, and radially outwardly with respect to the second strip for another part of the disc length.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow.

The invention claimed is:

1. A transformer comprising:

a winding disposed as wrapped around a magnetic core, the winding having at least one winding portion extending between a central core disposition and the exterior of the winding in a radial direction, the winding comprising at least a first conductor and at least a second conductor and an insulating layer, the first and second conductors being arranged radially adjacent to each other in each winding portion with the interposition of the insulating layer, the first conductor being arranged radially inwardly with respect to the second conductor for part of each winding portion length, and radially outwardly with respect to the second conductor for another part of each winding portion length, the first conductor being passed at least in part from one side of the second conductor to the other side of the second conductor, the second conductor being structurally continuous all along the length of each winding portion, the second conductor comprising a substantially similar width along all the length of each winding portion, and the first conductor comprising a first intermediate end and a second intermediate end; wherein the first intermediate end and the second intermediate end are conductively connected together by one or more discrete structural connectors in a region protruding beyond the width of the second conductor.

2. A transformer according to claim 1, wherein the second intermediate end comprises a plurality of holes and the first intermediate end comprises a plurality of fasteners configured to be respectively each fitted into a corresponding one of the plurality of holes.

3. A transformer according to claim 1, comprising a first socket welded to the first intermediate end and a second socket welded to the second intermediate end, each socket having a first leg, a second leg and one or more bight portions joining the first and second legs to each other.

4. A transformer according to claim 3, wherein the first and the second sockets are made of Aluminum or Copper.

* * * * *